US008025743B2

(12) United States Patent
Poyner et al.

(10) Patent No.: US 8,025,743 B2
(45) Date of Patent: Sep. 27, 2011

(54) SAFETY ARRANGEMENT FOR A DISHWASHER, AND ASSOCIATED APPARATUS

(75) Inventors: Dennis A. Poyner, Kinston, NC (US); Ashwin Jadhav, New Bern, NC (US); David Sumner, Greenville, NC (US)

(73) Assignee: Electrolux Home Products, Inc., Cleveland, OH (US)

( * ) Notice: Subject to any disclaimer, the term of this patent is extended or adjusted under 35 U.S.C. 154(b) by 206 days.

(21) Appl. No.: 12/348,560

(22) Filed: Jan. 5, 2009

(65) Prior Publication Data

US 2010/0170541 A1 Jul. 8, 2010

(51) Int. Cl.
*B08B 3/02* (2006.01)

(52) U.S. Cl. ..... 134/57 D; 134/56 D; 134/58 D

(58) Field of Classification Search ..... 134/113, 134/176, 179
See application file for complete search history.

(56) References Cited

U.S. PATENT DOCUMENTS

| | | | | |
|---|---|---|---|---|
| 6,662,814 | B2 * | 12/2003 | Tobbe et al. | 134/176 |
| 6,666,219 | B2 | 12/2003 | Raches | |
| 2006/0060215 | A1 * | 3/2006 | Lee | 134/18 |
| 2006/0118148 | A1 * | 6/2006 | Jeong et al. | 134/58 D |
| 2008/0173798 | A1 | 7/2008 | Weisser et al. | |
| 2008/0186170 | A1 | 8/2008 | Schleifer | |

FOREIGN PATENT DOCUMENTS

| | | | |
|---|---|---|---|
| DE | 40 20 898 | A1 | 1/1992 |
| DE | 101 21 083 | A1 | 10/2002 |
| EP | 0 053 231 | A1 | 6/1982 |
| EP | 0 569 733 | A1 | 11/1993 |
| FR | 2 442 618 | | 6/1980 |
| JP | 05-031063 | * | 2/1993 |
| JP | 07-313434 | * | 12/1995 |
| JP | 08299247 | A | 11/1996 |
| JP | 2001-087205 | * | 4/2001 |
| KR | 2005053273 | * | 6/2005 |

OTHER PUBLICATIONS

European Patent Office 1 238 622 Sep. 2002.*
European Patent Office 0 293 223 Nov. 1988.*

* cited by examiner

*Primary Examiner* — Frankie L Stinson
(74) *Attorney, Agent, or Firm* — Alston & Bird LLP

(57) ABSTRACT

A safety arrangement for a dishwashing appliance and an associated apparatus are provided. The dishwashing appliance has a door covering a forward access opening of a tub in a closed position. A sump assembly about a lower end of the tub receives washing fluid therein, and a lower spray arm is rotatable about an axis about the lower end. The lower spray arm is configured to spray washing fluid from the sump assembly toward the tub. A control device actuates the lower spray arm to spray the washing fluid. A detection device interacts with the lower spray arm, and directs the control device to prevent actuation of the lower spray arm in response to the detection device detecting an abnormal displacement of the lower spray arm and/or a force applied to the lower spray arm, both with respect to the axis, with the door in the closed position.

7 Claims, 5 Drawing Sheets

SAFETY ARRANGEMENT FOR A DISHWASHER, AND ASSOCIATED APPARATUS

BACKGROUND OF THE INVENTION

1. Field of the Invention

Embodiments of the present invention relate to dishwashing appliances and, more particularly, to a safety arrangement for a dishwashing appliance, and an apparatus associated therewith.

2. Description of Related Art

A dishwasher generally includes a tub defining an enclosure for receiving kitchenware to be washed, and one or more spray arms mounted in the interior of the tub. The spray arm(s) may be connected to a pump and configured to cooperate therewith for spraying water under pressure onto the kitchenware. Such a dishwasher generally includes a lower rack for holding larger kitchenware items such as dinner plates, pots, pans, and the like, and an upper rack for holding glassware, smaller bowls, and the like. Each rack is typically configured to be movable into and out of the tub of the dishwasher so as to facilitate loading and unloading of the kitchenware. With such a dishwasher configuration, there may exist a possibility that a small child may remove the lower rack of a dishwasher and enter the resulting empty space within the tub. However, if the dishwasher door somehow becomes closed, and the dishwasher unit then actuated, the small child enclosed therein may be at risk of suffering injury.

Thus, there exists a need for a safety apparatus for a dishwasher capable of detecting instances when a child may be enclosed within the dishwasher and respond accordingly to prevent injury to the child.

BRIEF SUMMARY OF THE INVENTION

The above and other needs are met by the present invention which, according to one aspect, provides a dishwashing appliance, comprising a tub portion defining a forward access opening and having a lower end. A sump assembly is disposed about the lower end of the tub portion for receiving the washing fluid therein. A door assembly is pivotably engaged with the tub portion about the lower end, and is movable between an open position and a closed position. The door assembly is configured to cooperate with the tub portion to cover the forward access opening in the closed position. A lower spray arm is rotatable about an axis and is disposed about the lower end of the tub portion. The lower spray arm is configured to spray washing fluid from the sump assembly toward the tub portion. A control device is configured to actuate the lower spray arm to spray the washing fluid. A detection device is in communication with the control device and is configured to interact with the lower spray arm. The detection device is further configured to direct the control device to prevent actuation of the lower spray arm in response to the detection device detecting at least one of an abnormal displacement of the lower spray arm and a force applied to the lower spray arm, both with respect to the axis, with the door assembly in the closed position.

Another aspect provides a safety arrangement for a dishwashing appliance having a door assembly pivotably engaged with a tub portion and movable between an open position and a closed position, wherein the door assembly is adapted to cooperate with the tub portion to cover the forward access opening in the closed position. The dishwashing appliance further includes a sump assembly disposed about a lower end of the tub portion for receiving washing fluid therein, and a lower spray arm rotatable about an axis and disposed about the lower end of the tub portion. The lower spray arm is configured to spray washing fluid from the sump assembly toward the tub portion. Such a safety arrangement comprises a control device configured to actuate the lower spray arm to spray the washing fluid. A detection device is in communication with the control device and is configured to interact with the lower spray arm. The detection device is further configured to direct the control device to prevent actuation of the lower spray arm in response to the detection device detecting at least one of an abnormal displacement of the lower spray arm and a force applied to the lower spray arm, both with respect to the axis, with the door assembly in the closed position.

Aspects of the present invention thus provide significant advantages as otherwise detailed herein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE DRAWINGS

The present disclosure now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
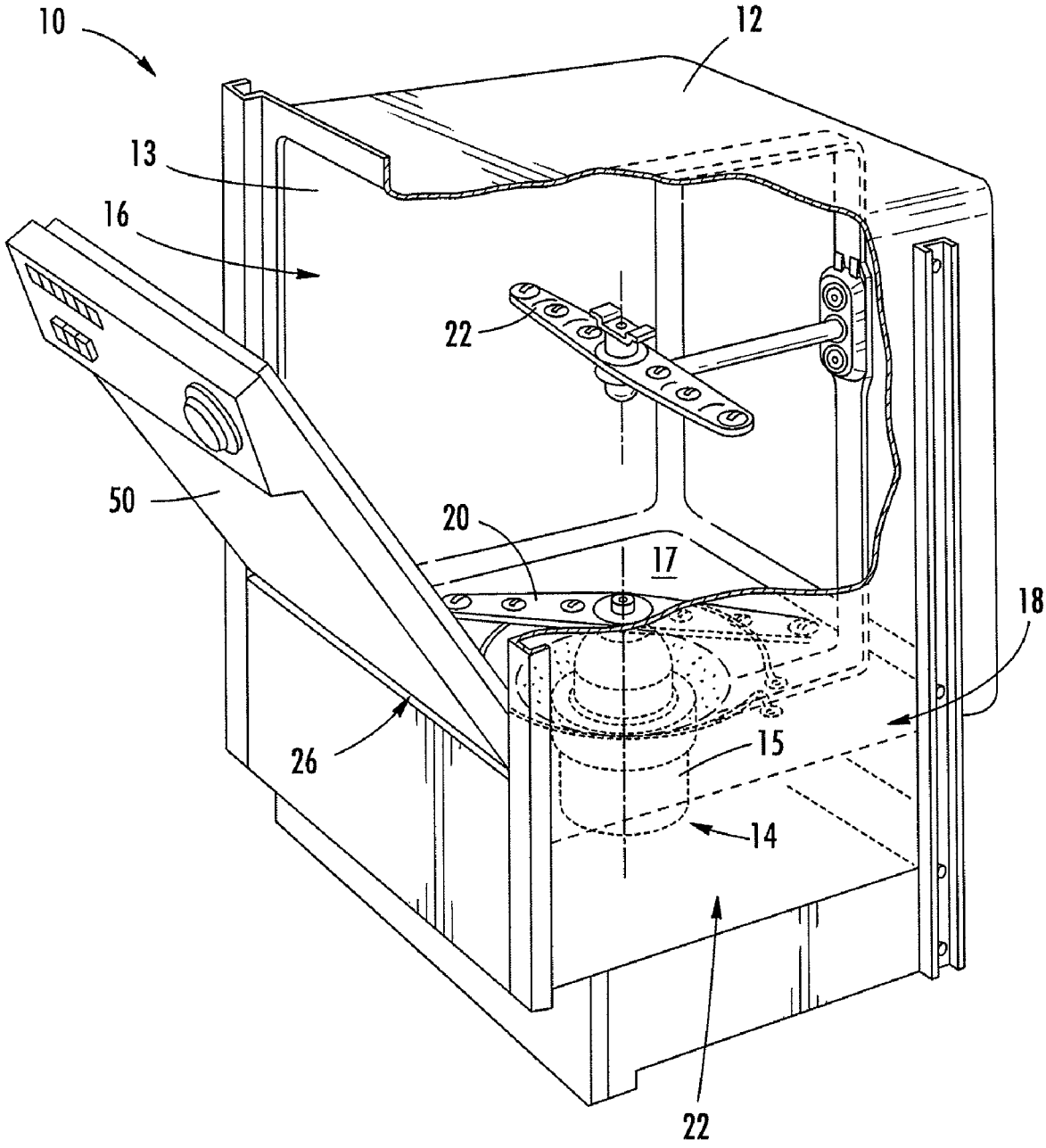
FIG. 1 is a perspective view of a dishwasher capable of implementing various embodiments of the present disclosure.

FIG. 1 illustrates one example of a dishwashing appliance, such as a dishwasher 10, capable of implementing various embodiments of the present invention. Such a dishwasher 10 typically includes a tub portion 12 (partly broken away in FIG. 1 to show internal details) having a plurality of walls (e.g., side wall 13) for forming an enclosure in which dishes, utensils, and other dishware or kitchenware may be placed for washing. The tub portion 12 may also define a forward access opening, generally designated as 16. A door assembly 50 may be pivotably engaged with the tub portion 12 about the lower end 18 thereof so as to selectively permit access to the interior of the tub portion 12. That is, a lower edge 26 of the door assembly 50 may be pivotably engaged (i.e., hinged) with the lower end 18 of the tub portion 12 such that the door assembly 50 is pivotable about the lower edge 26 thereof to provide access to the interior of the tub portion 12 through the forward access opening 16, and to cover and seal the forward access opening 16 when the dishwasher 10 is in operation.

The tub portion 12 may further define or have engaged therewith a sump (or sump assembly), generally designated as 14, in which wash water or rinse water is collected, typically under the influence of gravity. The sump 14 may cooperate with a bottom wall 17 of the tub portion 12 to form the lower end 18 of the tub portion 12, wherein the bottom wall 17 may be sloped to direct washing fluid toward the sump 14. The wash/rinse water may be pumped/recirculated by a circulation pump assembly 15 out of the sump 14 to various spray arms (e.g., lower spray arm 20 and upper spray arm 22) mounted in the interior of the tub portion 12, from which the wash/rinse water is sprayed, under pressure, onto the dishes, utensils, and other dishware or kitchenware contained therein. Further, a drain system may be connected to or otherwise in fluid communication with the sump 14 for removing the dishwashing fluid from the dishwasher 10 via a house drain, wherein the drain system may include a drain pump assembly configured to pump dishwashing fluid to the house drain line. The operational components (e.g., water valve, circulation pump, drain pump) of the dishwasher 10 may be housed, disposed, or otherwise positioned within a base portion/component 22 beneath the tub portion 12, wherein the base portion 22 receives and supports the lower end 18 of the tub portion 12. In some instances, the base portion 22 may be a separate component with respect to the tub portion 12, such as, for example, a molded polymer component, while in other instances, the base portion 22 may be integral with the tub portion 12 such that the side walls forming the tub portion 12 also at least partially form the base portion 22.

Figure 2:
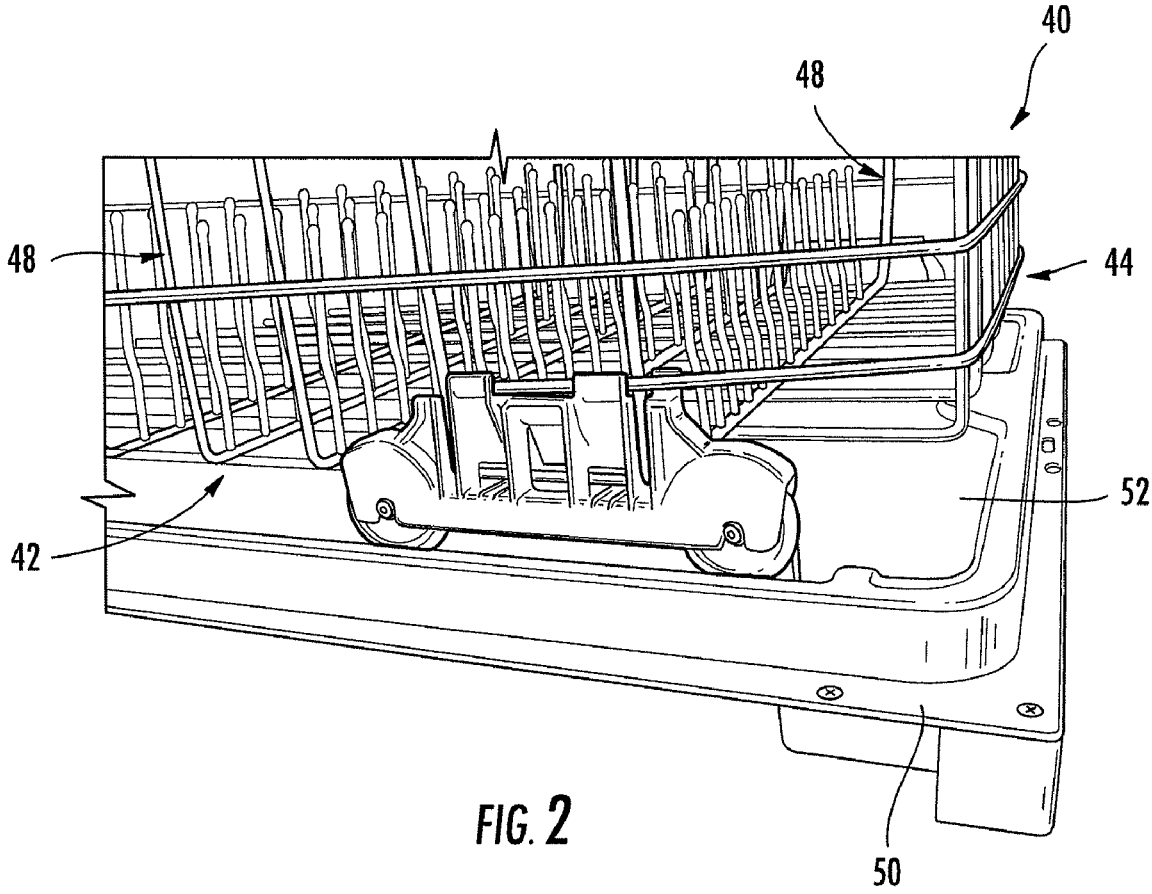
FIG. 2 is a partial perspective view of a lower rack for a dishwasher, wherein the lower rack is capable of being removed from the dishwasher.

The dishwasher 10 may also include movable lower and upper racks for holding the dishes, utensils, and dishware or kitchenware to be washed. That is, a dishwasher 10 typically includes a lower rack and an upper rack, both of which may be movable into and out of the tub portion 12 of the dishwasher 10 to facilitate loading and unloading of dishes and utensils. For example, and with reference to FIG. 2, the dishwasher may include a lower rack 40 located proximate the bottom wall 17 of the tub portion 12, and an upper rack (not shown) spaced vertically above the lower rack 40, both being movable into and out of the tub portion 12 when the door assembly 50 is in the open position (i.e., not blocking access to the interior of the tub portion 12). Each of the racks may be formed generally as a wire frame structure comprising, for example, a plurality of wires arranged to intersect one another at discrete points, at which the wires are secured to one another so as to define an open container configured to receive and support dishware or kitchenware therein and to allow dishwashing fluid to pass freely therethrough. In some instances, the lower rack 40 may have a bottom wall 42, a front wall 44 extending generally vertically upwardly from a front edge of the bottom wall 42, a rear wall (not shown) extending generally vertically upwardly from a rear edge of the bottom wall 42, and a pair of spaced side walls 48 extending generally vertically upwardly from opposite side edges of the bottom wall 42.

In operation, the door assembly 50 may be pivoted to an open position, thus allowing the lower rack 40 to be moved out of the tub portion 12 to facilitate loading and unloading of dishware when the door assembly 50 of the dishwasher 10 is in an "open" position. Generally, the lower rack 40 is at least partially supported by an interior portion 52 of the door assembly 50 when the door assembly 50 is in the open position, wherein the interior portion 52 faces the interior of the tub portion 12 when the door assembly 50 is in the closed position. In some dishwashers, a handle or grasping region (not shown) may be provided on the front wall 44 of each rack (upper and lower) to allow the user to grasp and pull the rack out of the tub portion 12. In some instances, the racks, particularly the lower rack 40, may be capable of being readily removed from the dishwasher 10, since the lower rack 40 is generally not permanently attached or secured to the tub portion 12 or other component of the dishwasher 10. As such, it may be possible for a child to entirely remove the lower rack 40 from the dishwasher 10. The space thus created by removal of the lower rack 40 may allow the child to climb into or otherwise enter the tub portion 12 of the dishwasher 10. In such instances, a risk is presented wherein the door assembly 50 could be pivoted to the closed position with the child inside the tub portion 12 and, once the door assembly 50 is closed, it may be possible to initiate a wash cycle. Initiation of a wash cycle with the child within the tub portion 12 may thus result in a risk of injury to the child.

Figure 3:
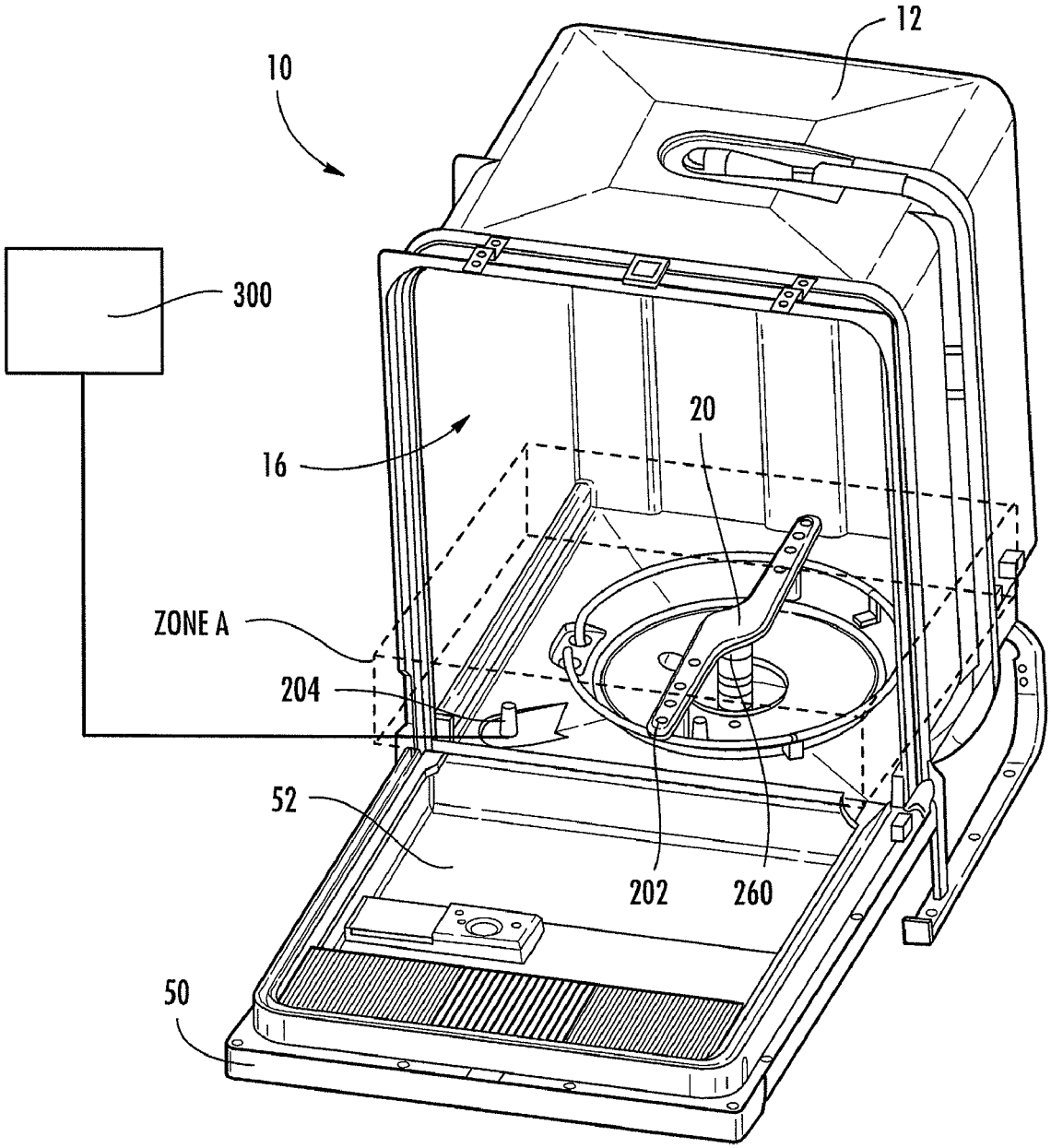
FIG. 3 is a perspective view of a dishwasher capable of implementing various embodiments of the present disclosure, identifying a monitored zone according to one embodiment of the present disclosure.
Figure 4:
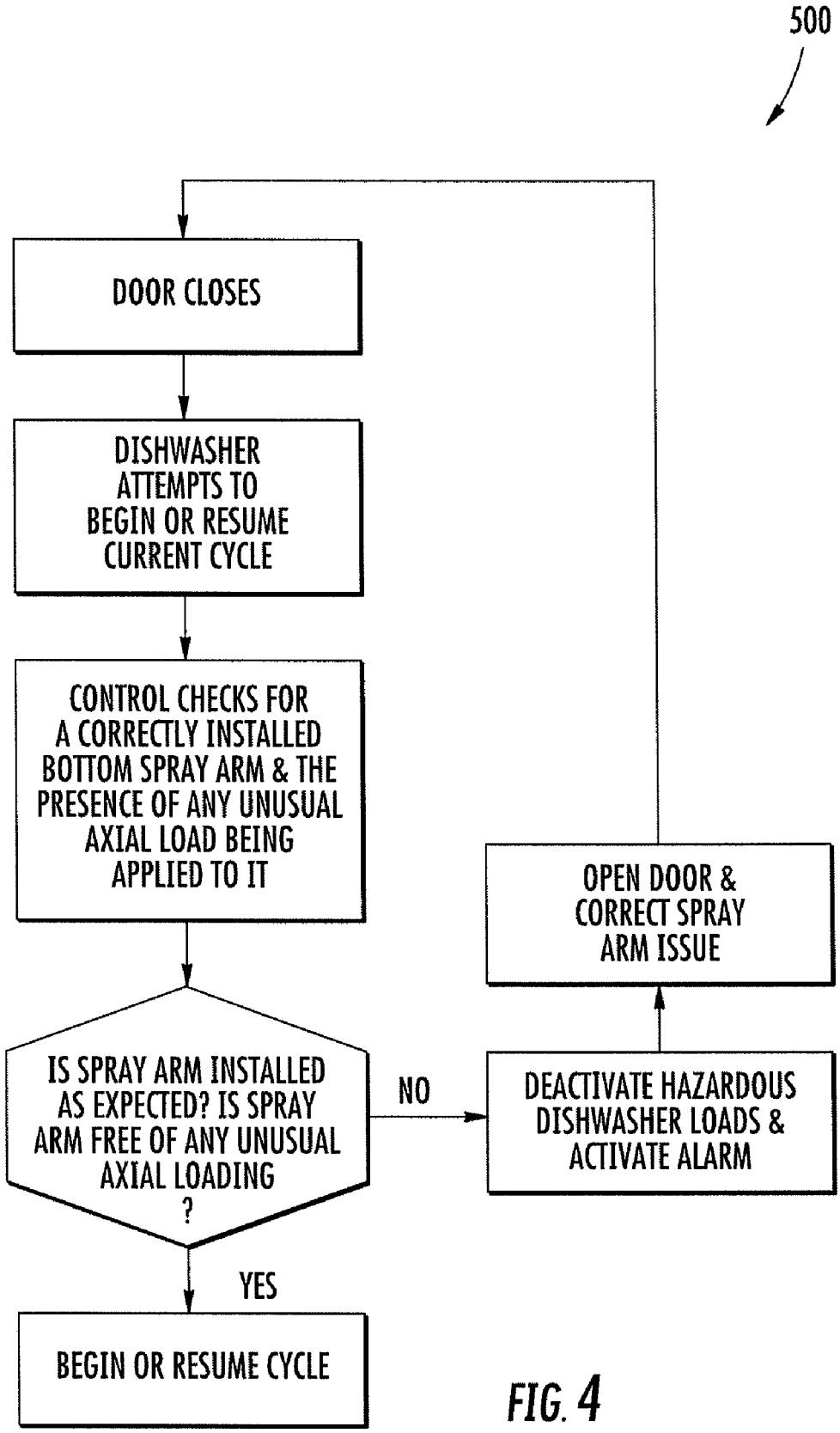
FIG. 4 is a schematic of an algorithm capable of being implemented by a control device associated with a dishwasher, according to one embodiment of the present disclosure.
Figure 5:
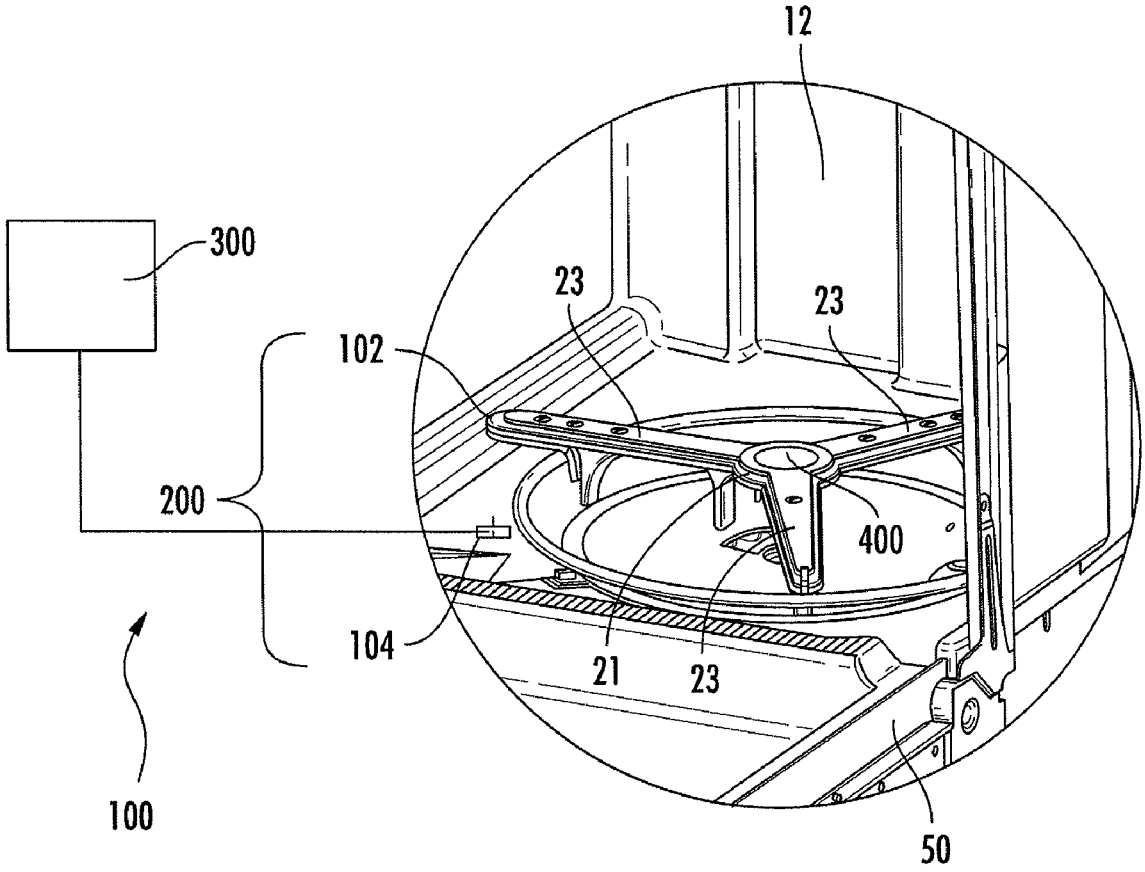
FIG. 5 is a fragmentary view of a dishwasher having a detection device disposed about a lower end of the dishwasher tub portion, in accordance with one embodiment of the present disclosure.

In accordance with embodiments of the present disclosure, with reference to FIGS. 3-5, the dishwasher 10 may thus include a safety provision, such as, for example, a safety arrangement, generally designated as 100, including a detection device 200 for detecting/sensing particular interference with or hindrance of the lower spray arm 20 of the dishwasher 10, wherein such a safety arrangement may be configured to be appropriately responsive to the detection device 200 when such interference/hindrance is detected. For example, the detection device 200 may direct the dishwasher 10 (i.e., through a control device 300 in communication therewith and configured to otherwise control operation of various components of the dishwasher 10, for example, to actuate the lower spray arm to spray the washing fluid) to be rendered inoperable if particular interference with or hindrance of the lower spray arm 20 of the dishwasher 10 is detected. More particularly, in one aspect, the dishwasher 10 may be rendered inoperable by the safety arrangement 100 (and/or an auditory alarm actuated) if a child removes the lower rack 40, enters the dishwasher 10, and makes certain physical contact with the lower spray arm 20 (i.e., sits or leans on the lower spray arm 20) to cause an interference with or hindrance of the normal operation of the lower spray arm 20 (i.e., the lower spray arm 20 becomes incapable of rotating as intended), as sensed by the detection device 200.

More particularly, the lower spray arm 20 may include a hub portion 21 with at least one spoke portion 23 extending therefrom. The hub portion 21 may be further configured to be operably engaged with an axial member 260 (see, e.g., FIG. 3) associated with the sump assembly 14 and defining an axis about which the hub portion 21 (and thus the at least one spoke portion 23) rotates. In doing so, the axial member 260 may be configured to supply the washing fluid therethrough to the hub portion 21 which, in turn, directs the washing fluid to the at least one spoke portion 23 for emission therefrom onto the dishware/kitchenware in the tub portion 12.

The detection device 200 is desirably configured in an appropriate manner to detect or otherwise determine particular abnormal conditions that may occur in instances of a child being closed within the dishwasher 10. In such instances, removal of the lower rack 40 by the child, and subsequent entry of the child into the tub portion 12, may often result in some interaction between the child and the now-exposed lower spray arm 20. As a result of this interaction, the hub portion 21 and/or the at least one spoke portion 23 of the lower spray arm 20 may have a force applied thereto with respect to the axis. In other instances, this interaction may be manifest as a displacement of the hub portion 21 and/or the at least one spoke portion 23 of the lower spray arm 20. In either instance, it may not be possible for the lower spray arm 20 to operate as intended. Accordingly, it may desirable, in some instances, to detect such interaction and, in response, to take appropriate measures to prevent or otherwise reduce the risk of injury to the child within the unit. Accordingly, the detection device 200 may be configured to direct that the dishwasher 10 be rendered inoperable and/or that an appropriate alarm be actuated if, for example, the detection device 200 detects an axial load or force applied to the lower spray arm 20 toward the sump assembly 14, or any dislodgement or axial displacement of the lower spray arm 20 from its normally-installed position (or removal of the lower spray arm 20 from the dishwasher 10, altogether), due to the physical contact with the child.

The detection device 200 may thus be configured in many different manners, as will be appreciated by one skilled in the art. For instance, the detection device 200 may include multiple detection components, such as, for example, a first detection component 202 and a complementary second detection component 204, wherein one of the first and second detection components may be operably engaged with (i.e., disposed on or within) the lower spray arm 20, and the other of the first and second detection components may be operably engaged with (i.e., disposed in or around) the sump 14. The two detection components may thus be capable of cooperating to determine whether an axially-directed force is applied to the lower spray arm 20 or whether a displacement thereof is realized (i.e., that interferes with or otherwise hinders normal operation thereof). In one embodiment, the first detection component 202 may be disposed on the lower spray arm 20, and the second detection component 204 may be disposed about the sump 14 and/or the lower end of the tub portion 12.

In one particular instance, the first detection component 202 may comprise a transmitter device configured to transmit a signal indicative of a status of the lower spray arm 20, and the second detection component 204 may comprise a complementary detector device configured to receive the signal transmitted by the transmitter device. In such a manner, the first and second detection components 202, 204 may cooperate to provide a detection function that provides, for example, a particular signal when the interaction between the transmitter device and the detector device is "normal" and a different signal when the interaction between the transmitter device and the detector device is "abnormal" (i.e., indicative of whether an axially-directed force is applied to the lower spray arm 20 or whether a displacement thereof is realized (i.e., that interferes with or otherwise hinders normal operation thereof)). In such instances, the detection device 200 may be in communication with the control device 300. The control device 300 may be configured to direct operation of particular operational components of the dishwasher 10, wherein the control device 300 may be capable of selectively actuating a wash cycle to be executed by the dishwasher 10. As such, in response to an "abnormal" signal from the detection device 200, the control device 300 may be capable of rendering the dishwasher 10 inoperable (i.e., preventing a wash cycle or program from being initiated/actuated) and/or providing an auditory and/or visual alarm for alerting a user of this "abnormal" condition. In any instance, such a detection device 200 may be implemented in various dispositions about and proximities to the lower end of the tub portion 12 such as, for example, in zone A (illustrated by phantom lines) of the dishwasher 10, as shown in FIG. 3. Further, in providing the disclosed function(s), the detection device 200 may comprise, for example, one of an optically-operative detection device (i.e., a photoelectric sensor), a capacitively-operably detection device, an inductively-operable detection device, a magnetically-operable detection device, and a mechanically-operable detection device.

In particular aspects of the invention, upon detection of an abnormal condition of the lower spray arm 20 (i.e., determination of whether an axially-directed force is applied to the lower spray arm 20 or whether a displacement thereof is realized (i.e., that interferes with or otherwise hinders normal operation thereof)) due to interaction with the child, the detection device 200 may be configured to generate a signal indicative of the abnormal condition and to direct that signal to the control device 300 in communication therewith. In response to the abnormal condition signal, a control algorithm executed by the control device 300 may direct that particular components of the dishwasher 10, or the dishwasher 10 itself, be rendered inoperable until the abnormal condition is resolved. For example, the control device 300 may be configured to direct the de-actuation of (or otherwise prevent actuation of) particular electrical components of the dishwasher 10 that could directly or indirectly potentially cause harm to a child inside the washing compartment (i.e., the tub portion 12) when a wash cycle is actuated. FIG. 4 schematically illustrates an exemplary algorithm capable of being executed by the control device 300 implementing aspects of the safety arrangement 100 as disclosed herein.

In another aspect of the present invention, as shown in FIG. 5, the detection device 200 may comprise, for example, a force-sensitive sensor 400 operably engaged between the hub portion 21 of the lower spray arm 20 and the axial member 260 associated with the sump assembly 14. In such instances, the force-sensitive sensor 400 may be configured to determine a weight or force applied to the lower spray arm 20 along the axis toward the sump assembly 14

In other aspects, the detection device 200 may comprise a displacement sensor (in addition to or in the alternative to the force-sensitive sensor 400), operably engaged with one of the lower spray arm 20, the tub portion 12, and the sump assembly 14. In such instances, the displacement sensor may be configured to determine a displacement of the lower spray arm 20 relative to a rotational plane defined by the at least one spoke portion 23 rotating about the hub portion 21/axial member 260. For example, the displacement sensor may include first and second sensor elements 102, 104, configured to cooperate to determine a displacement of the lower spray arm 20 from a normal condition (i.e., relative to the normal rotational plane of the at least one spoke portion 23 and/or to the bottom surface 17 of the tub portion 12). In one particular example involving the lower spray arm 20 having a spoke-hub configuration, wherein a plurality of spoke portions 23 extends outwardly from the hub portion 21 such that the spoke portions 23 are spaced-apart from the bottom surface 17 of the tub portion 12 at substantially equal distances, the first sensor element 102 may be disposed on any or all of the spoke portions 23, while the second sensor element 104 may disposed on the bottom surface 17 of the tub portion 12 or on the sump assembly 14. The first and second sensor elements 102, 104 may be configured to cooperate with each other in order to determine the status of the lower spray arm 20 in regard to an abnormal condition, as described previously (i.e., an abnormal displacement of the lower spray arm 20), and to generate a signal in response thereto. Either or both of the first and second sensor elements 102, 104 may be in communication with the control device 300, such that the control device 300 can respond thereto to take appropriate action regarding the detected abnormal condition.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A dishwashing appliance, comprising:

a tub portion defining a forward access opening and having a lower end;

a sump assembly disposed about the lower end of the tub portion for receiving the washing fluid therein;

a door assembly pivotably engaged with the tub portion about the lower end, and movable between an open position and a closed position, the door assembly being configured to cooperate with the tub portion to cover the forward access opening in the closed position;

a lower spray arm rotatable about an axis and disposed about the lower end of the tub portion, the lower spray arm being configured to spray washing fluid from the sump assembly toward the tub portion, wherein the lower spray arm includes a hub portion with at least one spoke portion extending therefrom, the hub portion being operably engaged with an axial member associated with the sump assembly and defining the axis;

a control device configured to actuate the lower spray arm to spray the washing fluid; and a detection device in communication with the control device and configured to interact with the lower spray arm, the detection device being further configured to direct the control device to prevent actuation of the lower spray arm in response to the detection device detecting a force applied to the lower spray arm with respect to the axis, with the door assembly in the closed position prior to spraying washing fluid through the lower spray arm or initiating a wash cycle, wherein the detection device comprises a force-sensitive sensor operably engaged between the hub portion and the axial member, and wherein the force-sensitive sensor is configured to determine an axial force applied to the lower spray arm toward the sump assembly.

2. A dishwashing appliance according to claim 1, wherein the control device is configured to at least one of actuate an auditory alarm and render the dishwashing appliance inoperable, upon detection of the force applied to the lower spray arm with respect to the axis.

3. A dishwashing appliance according to claim 1, wherein the detection device is configured to generate a signal, indicative of the detection of the force applied to the lower spray arm with respect to the axis, and to direct the signal to the control device.

4. A safety arrangement for a dishwashing appliance having a door assembly pivotably engaged with a tub portion and movable between an open position and a closed position, the door assembly being adapted to cooperate with the tub portion to cover the forward access opening in the closed position, the dishwashing appliance further including a sump assembly disposed about a lower end of the tub portion for receiving washing fluid therein and a lower spray arm rotatable about an axis and disposed about the lower end of the tub portion, the lower spray arm being configured to spray washing fluid from the sump assembly toward the tub portion, wherein the lower spray arm includes a hub portion with at least one spoke portion extending therefrom, the hub portion being operably engaged with an axial member associated with the sump assembly and defining the axis, the safety arrangement comprising:

a control device configured to actuate the lower spray arm to spray the washing fluid; and a detection device in communication with the control device and configured to interact with the lower spray arm, the detection device being further configured to direct the control device to prevent actuation of the lower spray arm in response to the detection device detecting a force applied to the lower spray arm with respect to the axis, with the door assembly in the closed position prior to spraying washing fluid through the lower spray arm or initiating a wash cycle, wherein the detection device comprises a force-sensitive sensor operably engaged between the hub portion and the axial member, and wherein the force-sensitive sensor is configured to determine an axial force applied to the lower spray arm toward the sump assembly.

5. A safety arrangement according to claim 4, wherein the control device is configured to at least one of actuate an auditory alarm and render the dishwashing appliance inoperable, upon detection of the force applied to the lower spray arm with respect to the axis.

6. A safety arrangement according to claim 4, wherein the detection device is configured to generate a signal, indicative of the detection of the force applied to the lower spray arm with respect to the axis, and to direct the signal to the control device.

7. A dishwashing appliance, comprising:

a tub portion defining a forward access opening and having a lower end;

a sump assembly disposed about the lower end of the tub portion for receiving the washing fluid therein;

a door assembly pivotably engaged with the tub portion about the lower end, and movable between an open position and a closed position, the door assembly being configured to cooperate with the tub portion to cover the forward access opening in the closed position;

a lower spray arm rotatable about an axis and disposed about the lower end of the tub portion, the lower spray arm being configured to spray washing fluid from the sump assembly toward the tub portion;

a control device configured to actuate the lower spray arm to spray the washing fluid; and a detection device in communication with the control device and configured to interact with the lower spray arm, wherein the detection device is configured to detect an axial force applied to the lower spray arm and to direct the control device to prevent actuation of the lower spray arm in response to detecting the axial force with the door assembly in the closed position prior to spraying washing fluid through the lower spray arm or initiating a wash cycle.

* * * * *